US008579478B2

(12) United States Patent
Cristoforo

(10) Patent No.: US 8,579,478 B2
(45) Date of Patent: Nov. 12, 2013

(54) ATTACHABLE ILLUMINATION SYSTEM

(75) Inventor: Michael Cristoforo, Palm City, FL (US)

(73) Assignee: Sight Saver, LLC, Palm City, FL (US)

( * ) Notice: Subject to any disclaimer, the term of this patent is extended or adjusted under 35 U.S.C. 154(b) by 210 days.

(21) Appl. No.: 13/166,401

(22) Filed: Jun. 22, 2011

(65) Prior Publication Data

US 2011/0317402 A1 Dec. 29, 2011

Related U.S. Application Data

(60) Provisional application No. 61/357,791, filed on Jun. 23, 2010.

(51) Int. Cl.
*F21S 8/08* (2006.01)

(52) U.S. Cl.
USPC ..... 362/419; 362/427; 362/106; 362/371

(58) Field of Classification Search
USPC ..... 362/33, 217.01, 220, 217.1, 362/217.11–217.17, 249.01–249.03, 362/249.09, 249.1, 249.11, 362, 368, 362/370–372, 382, 396, 418–419, 421, 427, 362/432, 106
See application file for complete search history.

(56) References Cited

U.S. PATENT DOCUMENTS

| | | | |
|---|---|---|---|
| 1,294,752 | A | 2/1919 | Ballard |
| 4,506,317 | A | 3/1985 | Duddy |
| 4,678,153 | A | 7/1987 | Maddock et al. |
| 5,521,803 | A | 5/1996 | Eckert et al. |
| 5,717,267 | A | 2/1998 | Hsu |
| 6,280,050 | B1 | 8/2001 | Bird et al. |
| 6,718,136 | B2 | 4/2004 | Bird et al. |
| 6,764,194 | B1 | 7/2004 | Cooper |
| 6,874,908 | B2 | 4/2005 | Sharrah et al. |
| 7,311,418 | B2 | 12/2007 | Zeller et al. |
| 7,390,105 | B2 | 6/2008 | Nelson et al. |
| 7,422,356 | B2 | 9/2008 | Hama et al. |
| 7,425,082 | B1 | 9/2008 | Jones |
| 7,481,554 | B2 | 1/2009 | Anderson et al. |
| 7,510,295 | B2 | 3/2009 | Shih |
| D591,439 | S | 4/2009 | Cristoforo |
| D599,046 | S | 8/2009 | Cristoforo |
| D602,620 | S | 10/2009 | Cristoforo |
| 7,618,152 | B2 | 11/2009 | Tsung |
| D609,376 | S | 2/2010 | Cristoforo et al. |
| D619,285 | S | 7/2010 | Cristoforo |
| D649,668 | S | 11/2011 | Cristoforo |
| 2003/0067771 | A1 | 4/2003 | Kung |

(Continued)

FOREIGN PATENT DOCUMENTS

| | | |
|---|---|---|
| DE | 202007001258 | 4/2007 |
| WO | WO2011034773 | 3/2011 |

*Primary Examiner* — Donald Raleigh
(74) *Attorney, Agent, or Firm* — McHale & Slavin, P.A.

(57) ABSTRACT

This invention relates generally to an illumination system and, more particularly, to an illumination system that is configured for attachment to the frame portion of a pair of eyeglasses. The illumination system includes a light source and a multi-axis pivot assembly to permit directional adjustment and focus of a beam of light. An adapter clip is provided to facilitate attachment to the temple arm portion of the eyeglasses. The adapter clip includes a plurality of grooves positioned between two flexible side portions to allow the clip to be slid along the temple arm to a desired position and snapped into a locked position. The illumination system is fully adjustable in terms of light intensity and direction of the light beams.

16 Claims, 14 Drawing Sheets

(56) References Cited

U.S. PATENT DOCUMENTS

| | | | | |
|---|---|---|---|---|
| 2004/0141317 | A1 | 7/2004 | Sun | |
| 2005/0018420 | A1 | 1/2005 | Parsons | |
| 2006/0061991 | A1 | 3/2006 | Yeh | |
| 2006/0120066 | A1 * | 6/2006 | Huang | 362/105 |
| 2007/0030672 | A1 | 2/2007 | Offiler et al. | |
| 2007/0177375 | A1 | 8/2007 | Petzl | |
| 2009/0059607 | A1 | 3/2009 | Yoon | |
| 2009/0116230 | A1 | 5/2009 | Young | |
| 2010/0053944 | A1 | 3/2010 | Yao-Lin | |
| 2010/0103653 | A1 | 4/2010 | Liu | |
| 2010/0103656 | A1 | 4/2010 | Cho | |
| 2011/0063827 | A1 | 3/2011 | Cristoforo | |

* cited by examiner

ATTACHABLE ILLUMINATION SYSTEM

CROSS REFERENCE TO RELATED APPLICATIONS

This application is related to U.S. Pat. D591,439, issued on Apr. 28, 2009, entitled "Ear Hook With Removable Light"; U.S. Pat. D599,046, issued on Aug. 25, 2009, entitled "Ear Hook With Adjustable Boom Mounted Light"; U.S. Pat. D602,620, issued on Oct. 20, 2009, entitled "Eye Glass Clip With Adjustable Boom Mounted Light"; U.S. Pat. D609,376, issued on Feb. 2, 2010, entitled "Clip-On Light"; U.S. Pat. D619,285, issued on Jul. 6, 2010, entitled "Eyeglass Clip With Adjustable Boom Mounted Light"; U.S. application Ser. No. 29/338,460, filed Jun. 11, 2009, entitled "Ear Hook With Adjustable Boom Mounted Light"; and U.S. applicaton Ser. No. 12/878,713, filed Sep. 9/2010, entitled "Light System"; and claims priority under 35 USC 119(e) to the U.S. Provisional Application 61/357,791, filed Jun. 23, 2010, entitled "Attachable Illuminatioin System" the contents of which are incorporated herein in their entirety.

FIELD OF THE INVENTION

This invention relates generally to an illumination system and, more particularly, to an illumination system that is configured for attachment to various thin or small diameter structures. The illumination system includes a light source, a power switch configured to connect the light source to a power source, and a multi-axis pivot assembly to permit directional adjustment and focus of a beam of light.

BACKGROUND OF THE INVENTION

The need for proper illumination of an item for viewing in a poorly lit area is known, as is the use of lights and other illuminating devices attached to eyewear to create an illuminated surface. In general, assumptions are made regarding focal distances and light intensities when designing these devices. With reading glasses for example, these assumptions are often based on accepted norms such as average distance between the reading material and the eye glasses, and commonly used print or font sizes. The result is a single light source, or multiple light sources that are either formed integral to or otherwise permanently mounted to existing reading glasses that uni-directionally focus the light to a predetermined focal range at a given intensity. Therefore, the devices are not readily adjustable to either user preferences or reading conditions. In addition, the integral and/or fixed nature of the prior art devices make repairs, such as battery replacement of the lighting device, difficult or impossible.

There are many variables that non-adjustable reading lights do not account for, yet are necessary for creating a comfortable reading environment for the eyes. For example, a person's age or optical health determines how well one's optic nerve receives light, and thus one's comfortable focal distance under variable lighting conditions. The type, color, and quality of the paper the reading material is printed on also affects the amount of light required. Newspapers and most books use a soft, off-white paper that absorbs light and minimizes glare. Magazines, on the other hand, are often printed on high gloss white paper that requires a lower intensity, diffused light source for maximum eye comfort. The amount and directional location of any ambient light also needs to be considered and adjusted for. The inability to adjust to these and other variables may result in increasing the potential for eye strain or eye fatigue rather than minimizing it.

The limitations of using incandescent light bulbs for this application are also known. Incandescent light bulbs require substantially more electricity for operation when compared to LED light sources. In addition, incandescent light bulbs generate considerable heat that is usually not acceptable to the user when secured to the user's glasses.

More commonly this application uses LED's as the light source. LED's are low power light sources that offer a high lumen light emission. Prior art LED lighting devices are typically built into eye glass frames. One disadvantage to this type of construction is that the power source(s), wiring, switches, etc., must also be built into the frames. This construction requires the glasses to be significantly redesigned to incorporate the light assemblies. Many of the changes required to incorporate the hardware make the designs unpopular for fashion and add significant weight to the assembly. The changes in style and weight are required whether or not the owner of the glasses utilizes the light source.

Additionally, these same constraints and variables may be applied in areas other than recreational reading as well. For example, many jobs require workers to perform their duties in poorly lit work environments in an area where it is impractical to bring in an external light source. Various examples of this would be an electrician that may be working during an electrical outage, a coal miner, a construction worker, an auto mechanic, etc. Many of these workers are required to wear hard hats for safety reasons. Therefore, many hard hats are provided with a rectangular opening into which a mount is rigidly attached for a portable light. The mount includes a circular aperture having a thumb screw through which a flashlight is slid through the aperture and the thumb screw tightened against its side. This device includes several drawbacks. For example, the light extends away from the helmet making it susceptible to being caught in wiring, tree limbs, structures and the like. Because the light bracket is rigidly attached to the hard hat this may create a dangerous situation. In addition, the rigid attachment and thumbscrews prevent quick removal of the light for hand held usage. Still yet, the rigidly fixed mount does not provide the angular adjustment necessary for some lighting requirements.

Accordingly, there is a need for an attachable illumination system that is constructed and arranged for attachment to eyewear, hard hats and the like to provide illumination in poorly lit areas. More particularly, there is a need for an attachable illumination system where the light source is fully adjustable in terms of light intensity and direction of the light beams produced by the illumination system. Furthermore, it would be desirable if the attachable illumination system incorporated a light source and power source for efficiency packaged in a non-intrusive, comfortable and aesthetically pleasing manner. The light source should be removable and replaceable with respect to the mount, and should be adapted to be secured to various structures with a single adapter clip without modification.

SUMMARY OF THE INVENTION

This invention relates generally to an attachable illumination system and, more particularly, to an attachable illumination system that is configured for attachment to relatively thin structures such as the frame portion of a pair of eyeglasses or the edge of a hard hat. The attachable illumination system includes a light source, a power switch configured to connect the light source to a power source, and a multi-axis pivot assembly to permit directional adjustment and focus of a beam of light. An adapter clip is provided to facilitate attachment to the thin structure. One such adapter clip includes a tapered lead-in and at least one barb positioned between two flexible side portions to allow the clip to be slid over a surface to a desired position so that the barb engages opposite side portion of the clip or the material within the clip to maintain a locked position. Another adapter clip includes a plurality of grooves positioned between two flexible side portions to allow the clip to be slid along the temple arm of a pair of glasses to a desired position and snapped into a locked position. The illumination system is fully adjustable in terms of light intensity and direction of the light beams. Furthermore, the invention may provide a means to fully adjust the focus of the light beams from a narrow point of light to a relatively broad beam of light. This addresses the problem of eye strain caused by poor lighting by allowing the user to adjust the light beams to cover the precise area desired of the item being viewed. Additionally, the invention may provide a means to adjust the intensity of the light projected onto the item being viewed. This addresses the problem of eye fatigue caused by improper lighting by allowing the user to adjust how brightly an item is illuminated, thus preventing the need to stare at an item that is too dark, or the glare off an item that is too brightly illuminated. Furthermore, the invention may provide a means to adjust the directional focus of the light to the item being viewed. This addresses the problems of using an assumed focus distance which is fixed by allowing the user to adjust the direction of the light output so as to focus on an item at a distance that provides maximum eye comfort to the user. The attachable illumination system can be scaled to a variety of sizes.

The invention preferably utilizes LED's as the light source that emit white light, such as the Luxeon™ series LED's manufactured by Lumileds™. These LED's have a high flux output, 100,000 hour lifespan, operate on a low direct current (DC) voltage input signal, are fully dimmable, and operate at cool temperatures, making them ideal for attachment onto surfaces that are maintained in close proximity to the user's face. Of course, those skilled in the art will understand that various types of high intensity LED's are available in the industry, and that the invention is not limited to any particular configuration or design of a particular LED. The light source is preferably a self-contained removable and replaceable light assembly, such as a portable flashlight, that is constructed and arranged to snap into a mounting assembly. The light assembly includes a power switch, preferably incorporated into the bezel and configured to connect the light source to a battery power source. The light output from the light source may be adjustable in various intensity levels and focus upon rotation of the bezel. Rotation of the bezel preferably moves a parabolic reflector with respect to the LED light source to change the focus of the emitted light. A lens may be positioned at or about the distal end of the light assembly which may include curvatures and/or coloration to provide additional light characteristics and modifications as is known in the art. The light source preferably includes a battery, capacitor, bat-cap or other electrical storage means for storing a supply of electrical power for consumption by the LED(s). The electrical storage device is generally positioned within a cylindrical or other shaped tubular portion that is sized to cooperate in a removable and replaceable manner with the mounting assembly.

The mounting assembly includes an adapter clip, an offset arm and a friction tube. The adapter clip is constructed and arranged for securing the mounting assembly to a relatively thin structure or small diameter structure and includes the first portion of the first rotation assembly. The offset arm is generally L-shaped and includes the second portion of the first rotation assembly at a first end and the first portion of a second rotation assembly at a second end thereof. The first and second portions of the first rotation assembly snap together and preferably allow up to 360 degrees of rotational freedom about a first axis of rotation. The first portion of the second rotation assembly is formed onto the friction tube, and like the first rotation assembly, snaps together with the second portion of the second rotation assembly to allow up to 360 degrees of rotational freedom about a second axis of rotation. Each first portion of a rotation assembly includes a snap ring portion and a bearing race portion, while each second portion of a rotation assembly preferably includes a plurality of spring clips and a bearing portion. This combination allows the snap together assembly yet provides thrust and rotational bearings to accept loads and provide controlled rotation, while the spring clips maintain the assembly and provide a predetermined resistance to rotation. This allows the light to be positioned by the user so that the desired position is maintained during movement of the user.

Accordingly, it is an objective of the present invention to provide an illumination system that is constructed and arranged to be secured to a relatively small or thin structure.

It is another objective of the present invention to provide an illumination system for eyewear having multiple axes of movement for the light assembly permitting a wide range of adjustment and directing of the light source with respect to the eyewear.

It is yet another objective of the present invention to provide a clip adapter for securing an illumination system to the temple arm portion of eyeglasses.

It is yet another objective of the present invention to provide an adapter clip for securing an illumination system to the temple arm portion of eyeglasses that can be secured to temple arms of various sizes and shapes.

It is still yet another objective of the present invention to provide a mounting assembly having two axes of rotation that each provide 360 degrees of rotational freedom.

Still yet another objective of the present invention is to provide an illumination system adapter clip having an open edge for attachment to the edge portion of a thin structure.

A further objective of the present invention is to provide an illumination system mounting assembly that is constructed and arranged for attachment to the edge of a hat.

An even further objective of the present invention is to provide an illumination system mounting assembly that is constructed and arranged to break away upon receiving a predetermined force.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE FIGURES

FIG. 1OF is a section view taken along lines 10E-10F of FIG. 10D;

DETAILED DESCRIPTION OF THE INVENTION

Figure 1:
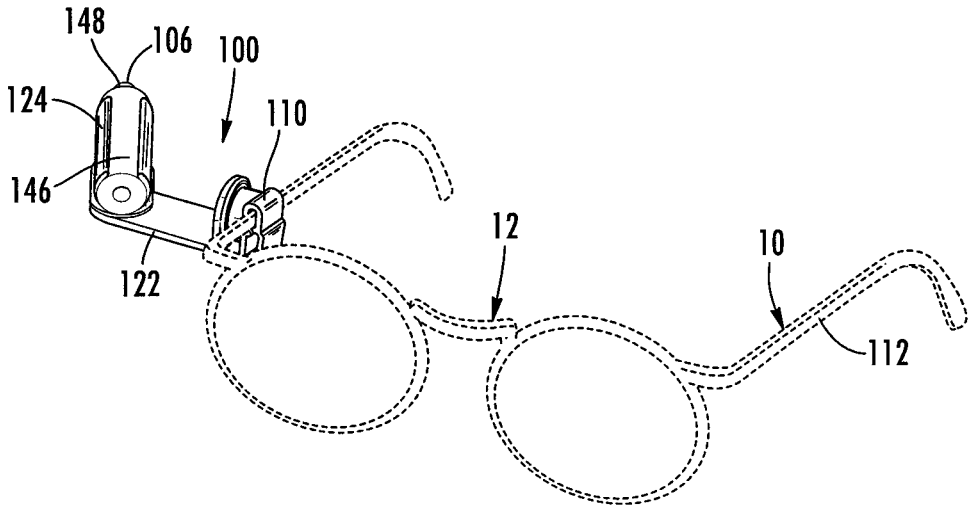
FIG. 1 is a perspective view of one embodiment of the present invention.
Figure 2:
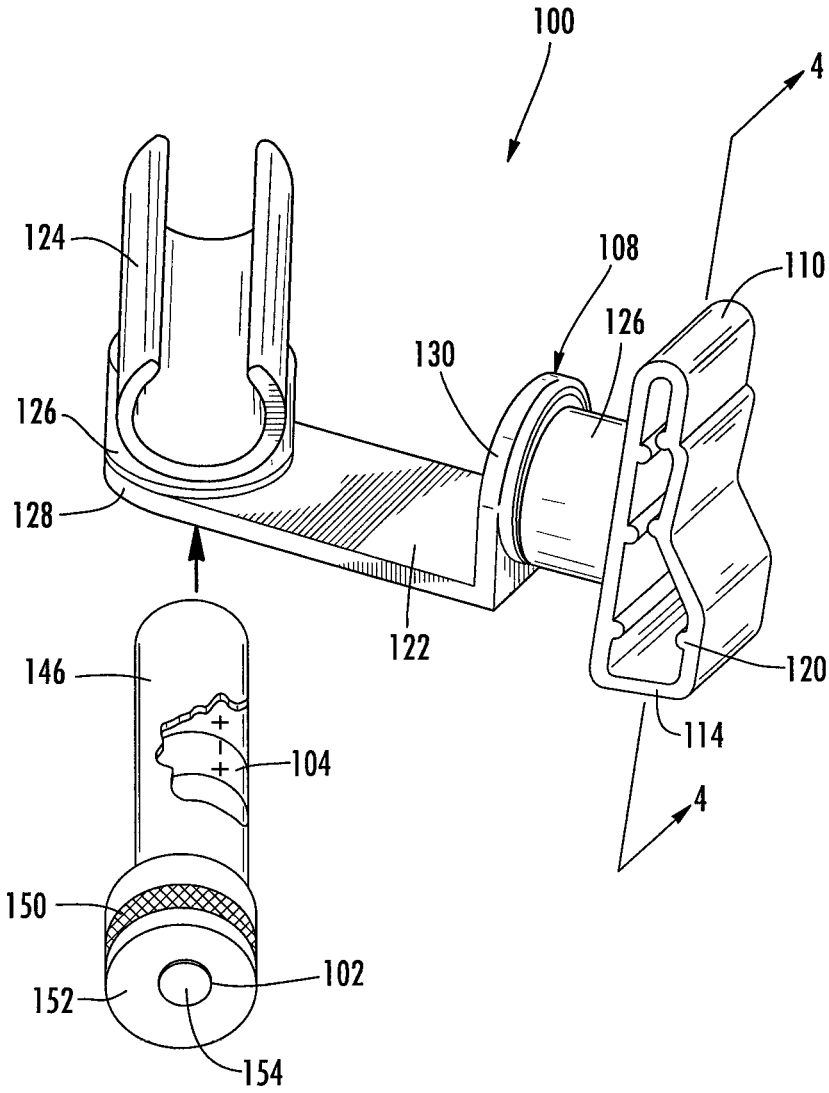
FIG. 2 is a perspective view partially exploded and partially in section of one embodiment of the present invention.
Figure 3A:
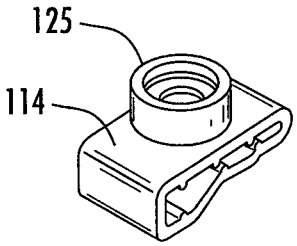
FIG. 3A is a perspective view of one embodiment of the closed adapter clip of present invention.
Figure 3B:
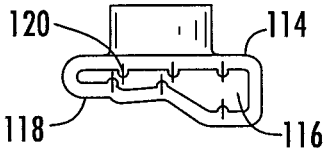
FIG. 3B is a side view of the closed adapter clip illustrated in FIG. 3A.
Figure 3C:
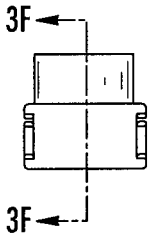
FIG. 3C is bottom view of the closed adapter clip illustrated in FIG. 3A.
Figure 3D:
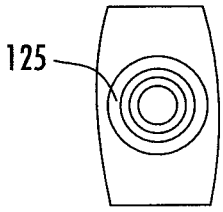
FIG. 3D is a front view of the closed adapter clip illustrated in FIG. 3A.
Figure 3E:
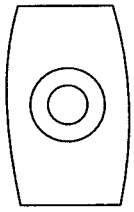
FIG. 3E is a rear view of the closed adapter clip illustrated in FIG. 3A.
Figure 3F:
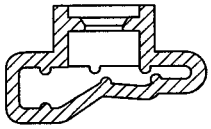
FIG. 3F is a section view taken along lines 3F-3F of FIG. 3C.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIGS. 1-13, an illumination system 100, 200 is illustrated. One embodiment of the illumination system 100 is configured for attachment to the frame portion 10 of a pair of eyeglasses 12 or the like. Another embodiment 200 (FIGS. 7-13) is constructed and arranged for attachment to a relatively thin structure such as a hard hat 250. The illumination systems 100, 200 generally include a light source 102, a power switch 106 configured to connect the light source 102 to a power source, illustrated herein as batteries 104, and a multi-axis pivot assembly 108 to permit directional adjustment and focus of a beam of light.

Figure 4:
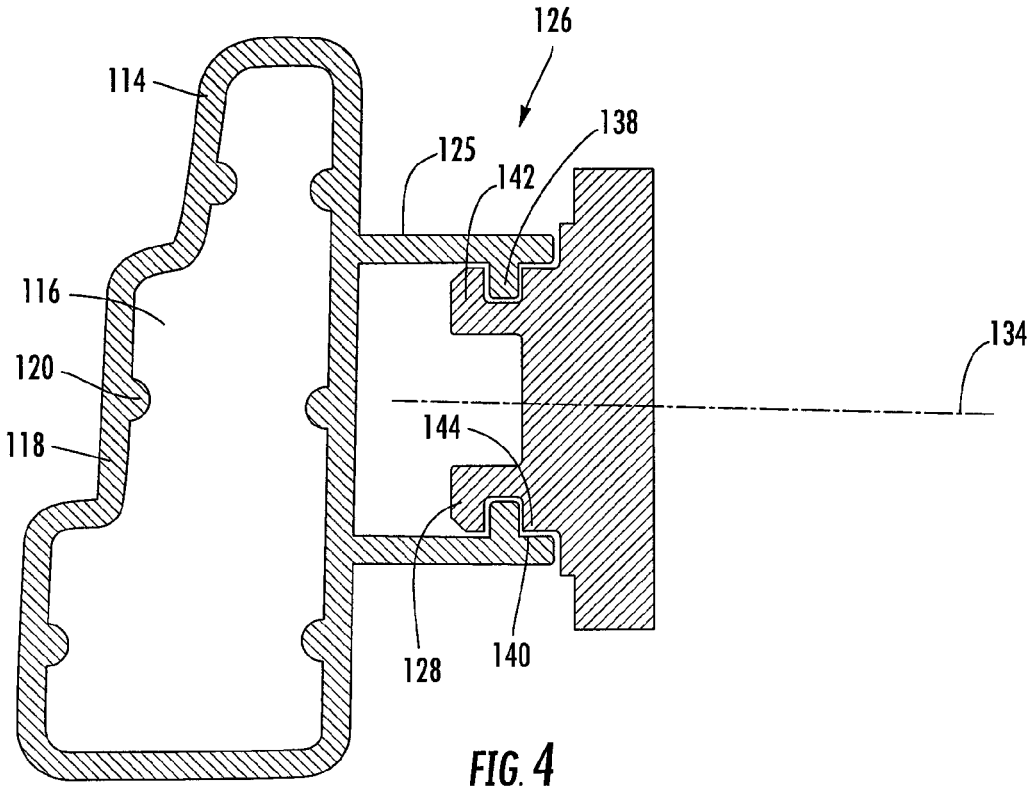
FIG. 4 is a partial section view taken along lines 4-4 of FIG. 2.
Figure 5A:
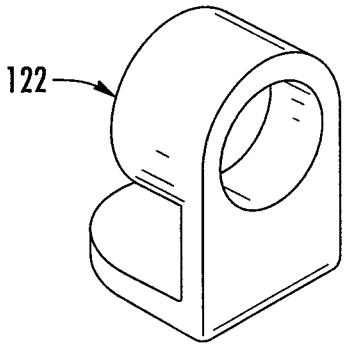
FIG. 5A is a perspective view of one embodiment of the offset arm of the present invention.
Figure 5B:
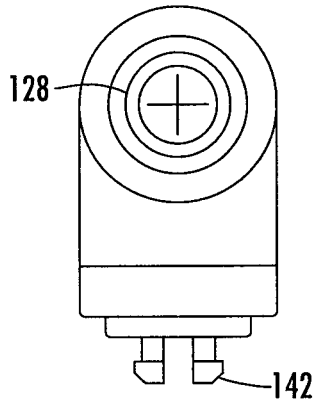
FIG. 5B is a front view of the offset arm illustrated in FIG. 5A.
Figure 5C:
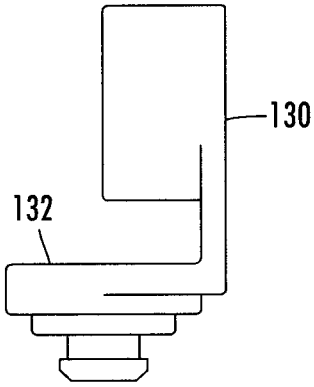
FIG. 5C is a right side view of the offset arm illustrated in FIG. 5A.
Figure 5D:
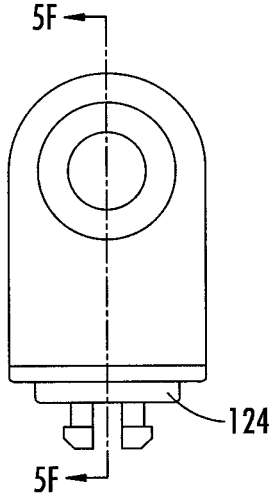
FIG. 5D is a rear view of the offset arm illustrated in FIG. 5A.
Figure 5E:
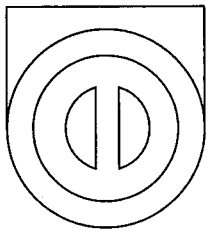
FIG. 5E is a bottom view of the offset arm illustrated in FIG. 5A.
Figure 5F:
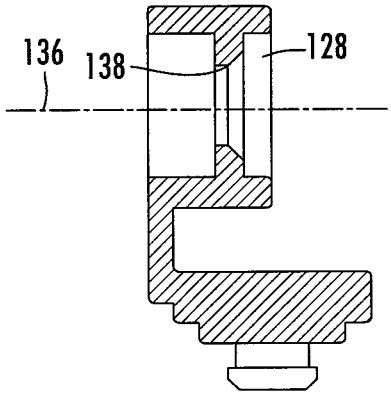
FIG. 5F is a section view taken along lines 5F-5F of FIG. 5D.
Figure 6:
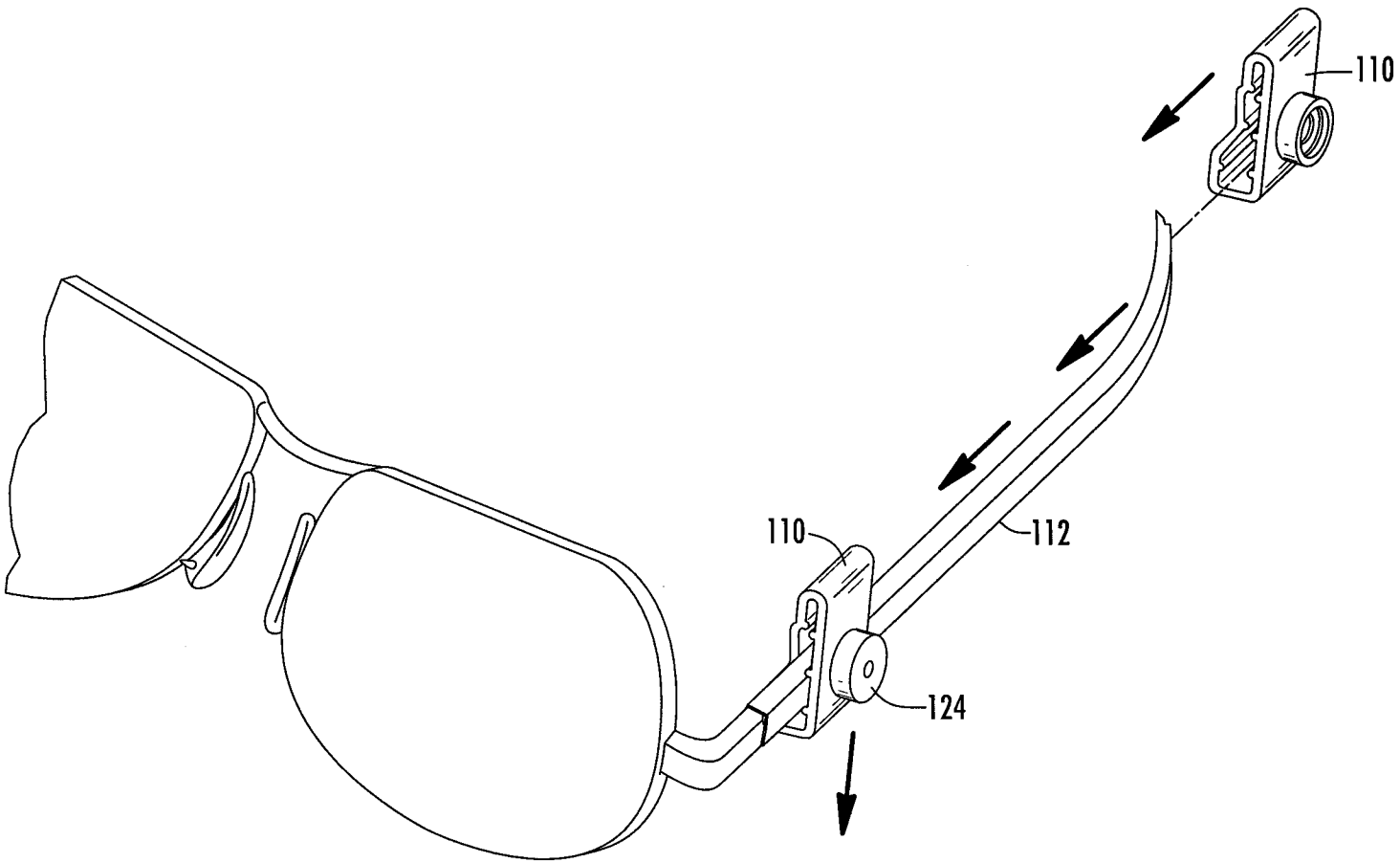
FIG. 6 is a perspective view illustrating assembly of the closed adapter clip to the temple arm of a pair of eyeglasses.
Figure 7A:
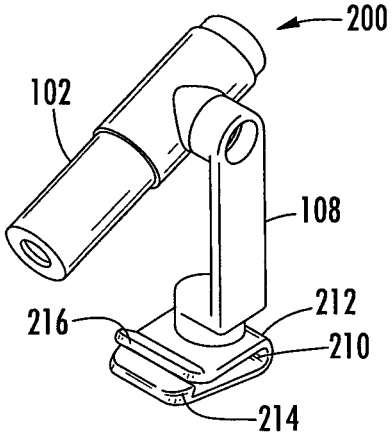
FIG. 7A is a perspective view of one embodiment of the present invention.
Figure 7B:
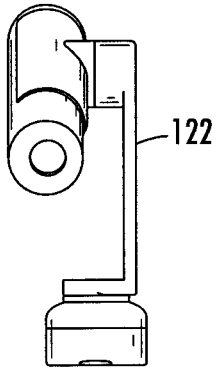
FIG. 7B is a front view of the embodiment illustrated in FIG. 7A.
Figure 7C:
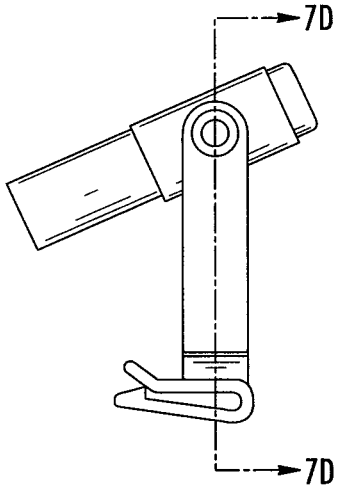
FIG. 7C is a right side view of the embodiment illustrated in FIG. 7A.
Figure 7D:
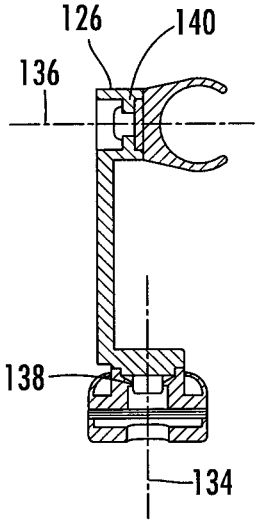
FIG. 7D is a section view taken along lines 7D-7D of FIG. 7C.
Figure 8A:
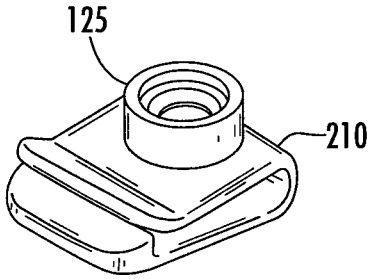
FIG. 8A is a perspective view of one embodiment of the open adapter clip of the present invention.
Figure 8B:
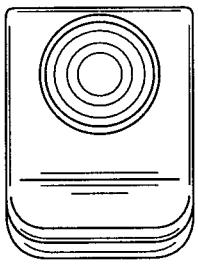
FIG. 8B is a top view of the open adapter clip illustrated in FIG. 8A.
Figure 8C:
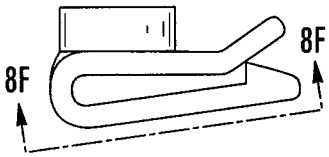
FIG. 8C is a left side view of the open adapter clip illustrated in FIG. 8A.
Figure 8D:
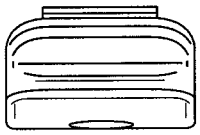
FIG. 8D is a front view of the open adapter clip illustrated in FIG. 8A.
Figure 8E:
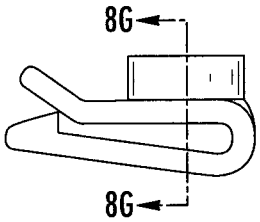
FIG. 8E is a right side view of the open adapter clip illustrated in FIG. 8A.
Figure 8F:
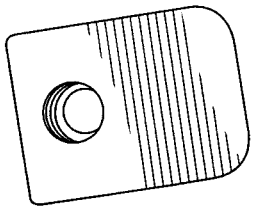
FIG. 8F is a bottom view taken along lines 8F-8F of FIG. 8C.
Figure 8G:
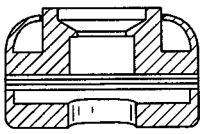
FIG. 8G is a section view taken along lines 8G-8G of FIG. 8E.
Figure 9A:
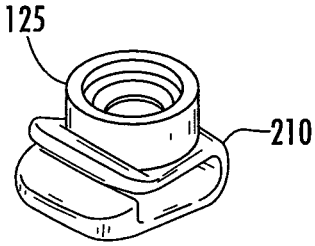
FIG. 9A is a perspective view of one embodiment of the open adapter clip of the present invention.
Figure 9B:
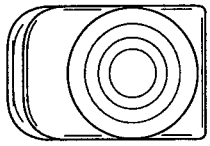
FIG. 9B is a top view of the open adapter clip illustrated in FIG. 9A.
Figure 9C:
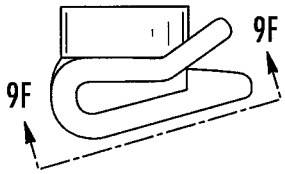
FIG. 9C is a left side view of the open adapter clip illustrated in FIG. 9A.
Figure 9D:
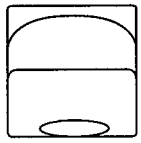
FIG. 9D is a front view of the open adapter clip illustrated in FIG. 9A.
Figure 9E:
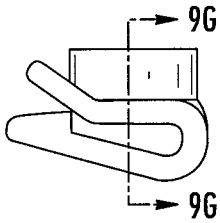
FIG. 9E is a right side view of the open adapter clip illustrated in FIG. 9A.
Figure 9F:
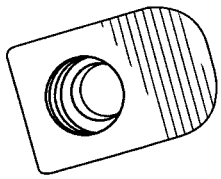
FIG. 9F is a bottom view taken along lines 9F-9F of FIG. 9C.
Figure 9G:
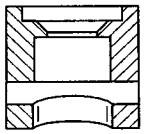
FIG. 9G is a section view taken along lines 9G-9G of FIG. 9E.
Figure 10A:
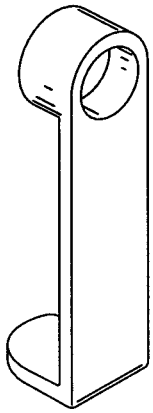
FIG. 10A is a perspective view of one embodiment of the offset arm of the present invention.
Figure 10B:
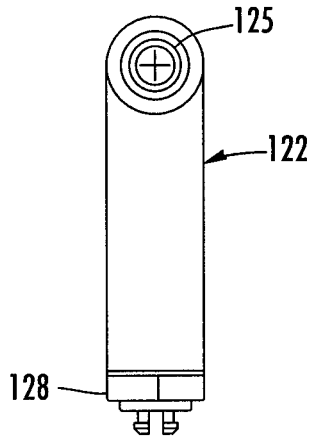
FIG. 10B is a front view of the offset arm illustrated in FIG. 10A.
Figure 10C:
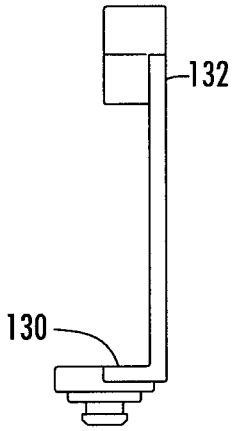
FIG. 10C is a right side view of the offset arm illustrated in FIG. 10A.
Figure 10D:
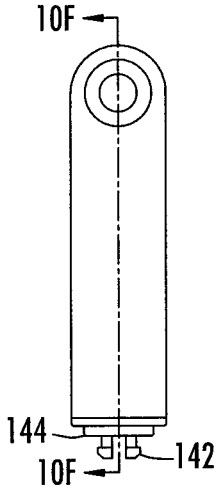
FIG. 10D is a rear view of the offset arm illustrated in FIG. 10A.
Figure 10F:
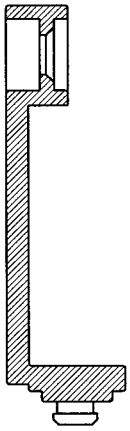
FIG. 10E is a bottom view of the offset arm illustrated in FIG. 10A.
Figure 10E:
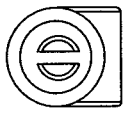
Figure 11A:
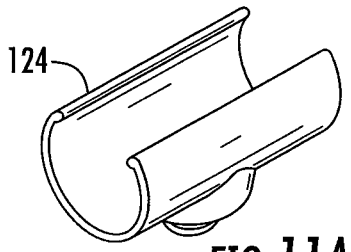
FIG. 11A is a perspective view of one embodiment of a friction tube suitable for use with the present invention.
Figure 11B:
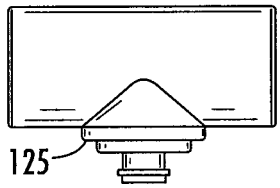
FIG. 11B is a right side view of the friction tube illustrated in FIG. 11A.
Figure 11C:
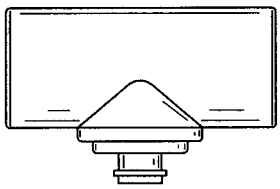
FIG. 11C is a left side view of the friction tube illustrated in FIG. 11A.
Figure 11D:
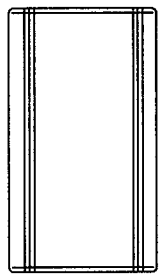
FIG. 11D is a top view of the friction tube illustrated in FIG. 11A.
Figure 11E:
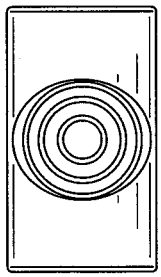
FIG. 11E is a bottom view of the friction tube illustrated in FIG. 11A.
Figure 11F:
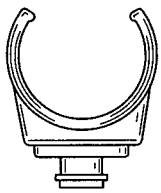
FIG. 11 F is a front view of the friction tube illustrated in FIG. 11A.
Figure 12:
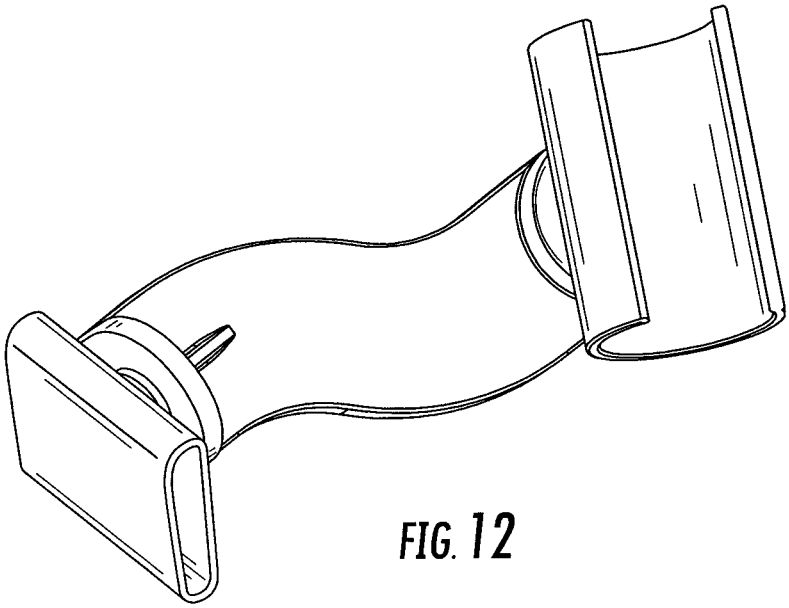
FIG. 12 is a perspective view of one embodiment of the multi-axis pivot assembly.
Figure 13:
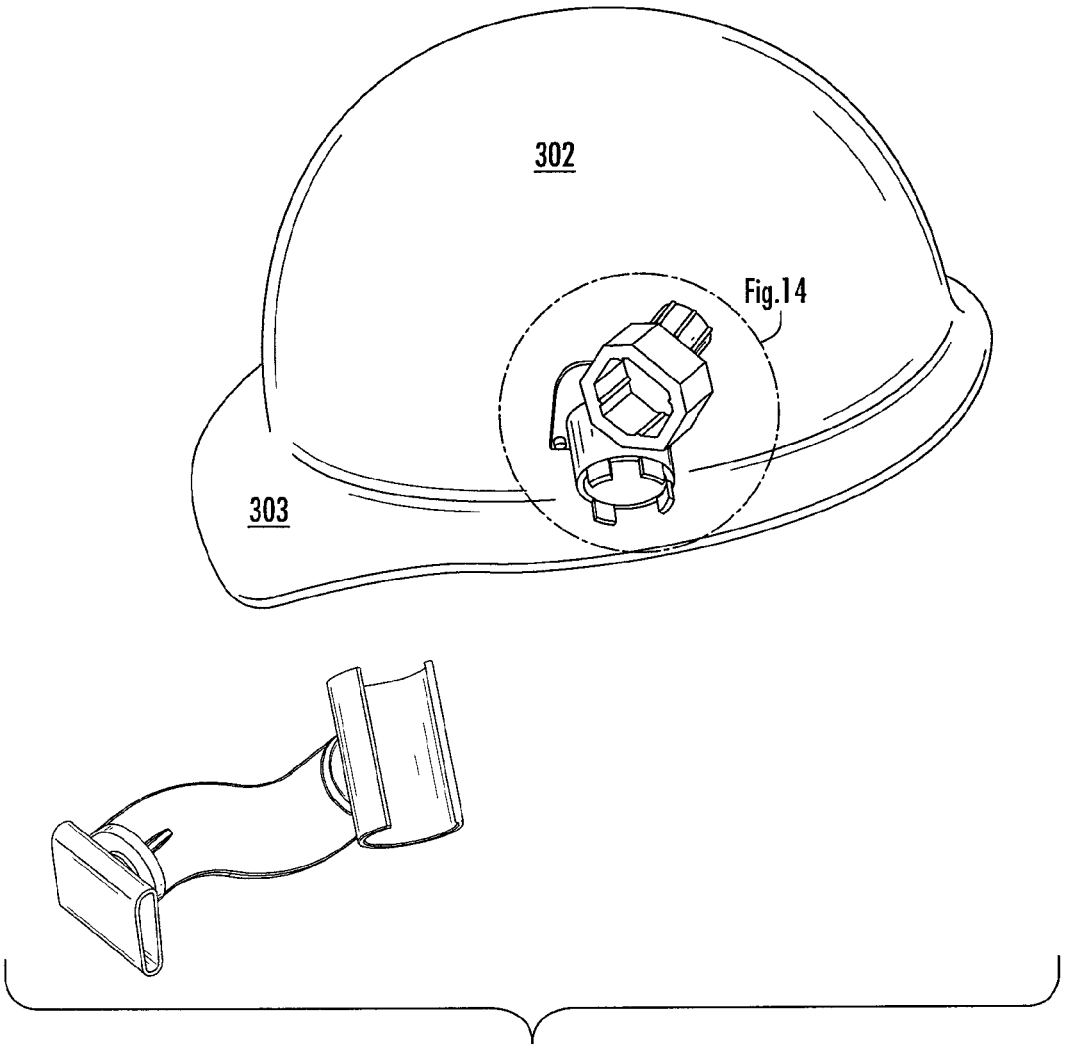
FIG. 13 is a perspective view illustrating the illumination system secured to a hard hat.

The multi-axis pivot assembly 108 includes an adapter clip 110, an offset arm 122 and a friction tube 124. One embodiment of the adapter clip 110 is closed to facilitate attachment to the temple arm portion 112 of the eyeglass frame 10. The adapter clip 110 includes a generally tubular portion 114 having a plurality of grooves 116 and ridges 120 positioned between two flexible side walls 118 to allow the clip 110 to be slid along the temple arm 112 to a desired position and snapped into a locked position, see FIG. 6. The grooves preferably include a variety of widths to cooperate with temple arms of various types and sizes and a most preferred embodiment includes grooves having descending widths. Ridges 120 may be positioned on one or both sides of each groove to cooperate with the temple arm to hold the clip in place and prevent unwanted rotation thereof. In operation, as the temple arm is moved past the ridges the sides 118 of the adapter clip flex to allow the temple arm to pass the ridges until it is received in the next groove. This process is repeated until the temple arm will no linger pass to the next smaller groove or until it reaches the smallest groove whereby the ridges secure the temple arm in place. The clips are preferably formed from a polymeric material such as plastic. However, it should be noted that other materials such as natural materials, metals or suitable combinations thereof may be utilized without departing from the scope of the invention. Another embodiment of the adapter clip 210 (FIGS. 7-9) is open along one edge for attachment to a relatively thin structure such as the edge of a hat 303 (FIG. 13). The open adapter clip 210 includes a generally U-shaped body portion 212. At least one of the edges adjacent the opening includes a bevel 216 for easy insertion over the thin structure separating the arms of the U-shaped body. A barb member 214 may be provided along the opposite arm for providing resistance to removing the clip from the thin structure. In general, the adapter clips 110, 210 are constructed and arranged for securing the multi-axis pivot assembly 108 to the temple arm 112 of the eyeglasses 12 and include the first portion 125 of the first rotation assembly 126. The offset arm 122 is generally L-shaped and includes the second portion 128 of the first rotation assembly 126 positioned on a first leg 130 of the offset arm and the first portion 125 of a second rotation assembly 126 on the second leg 132 thereof The first and second portions 125, 128 of the first rotation assembly 126 snap together, as illustrated in FIGS. 4 and 7, and preferably allow 360 degrees of rotational freedom about a first axis of rotation 134. The second portion 128 of the second rotation assembly 126 is formed onto the friction tube 124 and, like the first rotation assembly 126, snaps together with the second portion 128 of the second rotation assembly 126 to allow 360 degrees of rotational freedom about a second axis of rotation 136. Each first portion 125 of a rotation assembly 126 includes a snap ring portion 138 and a bearing race portion 140 while each second portion 128 of a rotation assembly preferably includes a plurality of spring clips 142 and a bearing portion 144. This combination allows the snap together assembly yet provides thrust and rotational bearings to accept loads to provide controlled rotation while the spring clips 142 maintain the assembly and provide a predetermined resistance to rotation. This allows the light source 102 to be positioned by the user so that the desired position is maintained during movement of the user. In addition, the construction of the pivot assembly provides several break-away points that allow the light source and/or portions of the pivot assembly to be pulled away in the event that they become entangled in wires or structures. The cooperation between the friction tube and the light source provides one break-away point, while each of the rotation assemblies and the clip itself provide additional break-away points. It should also be noted that the first an second portions of the rotation assemblies may be reversed in position without departing from the scope of the invention.

The light source 102 is preferably an LED light source that emits white light, such as the Luxeon™ series LED's manufactured by Lumileds™. These LED's have a high flux output, 100,000 hour lifespan, operate on a low DC voltage input signal, are fully dimmable, and operate at cool temperatures, making them ideal for attachment onto the eyeglasses. Of course, those skilled in the art will understand that various types of high intensity LED's are available in the industry, and that the invention is not limited to any particular configuration or design of a particular LED. The light source is preferably contained within a removable and replaceable self-contained light assembly 146 that is constructed and arranged to snap into the friction tube 124. The light assembly includes a power switch 106, which may be a mechanical switch 148 FIG. 1, but is preferably incorporated into the bezel 150 and configured to connect the light source to a battery power source 104 upon turning of the bezel 150. The light output from the light source may be adjustable in various intensity levels and focus upon rotation of the bezel. Rotation of the bezel preferably moves a parabolic reflector 152 with respect to the LED light source 102 to change the focus of the emitted light. A lens 154 may be positioned at or about the distal end of the light assembly which may include curvatures and/or coloration to provide additional light characteristics and modifications as is known in the art. It should be noted that while a specific embodiment of light source is illustrated, the construction of the multi-axis pivot assembly allows the device to cooperate with numerous designs of portable flashlights and/or laser pointers that include a generally cylindrical or elongated shaped portion sized to fit within the friction tube with an interference fit. It should also be noted that the preferable material for construction of the multi-axis pivot assembly is plastic, and thus the components have some resilient properties to allow flexing and bending without component breakage. The components of the multi-axis pivot assembly may alternatively be constructed of a rigid material such as metal without departing from the scope of the invention.

Figure 14:
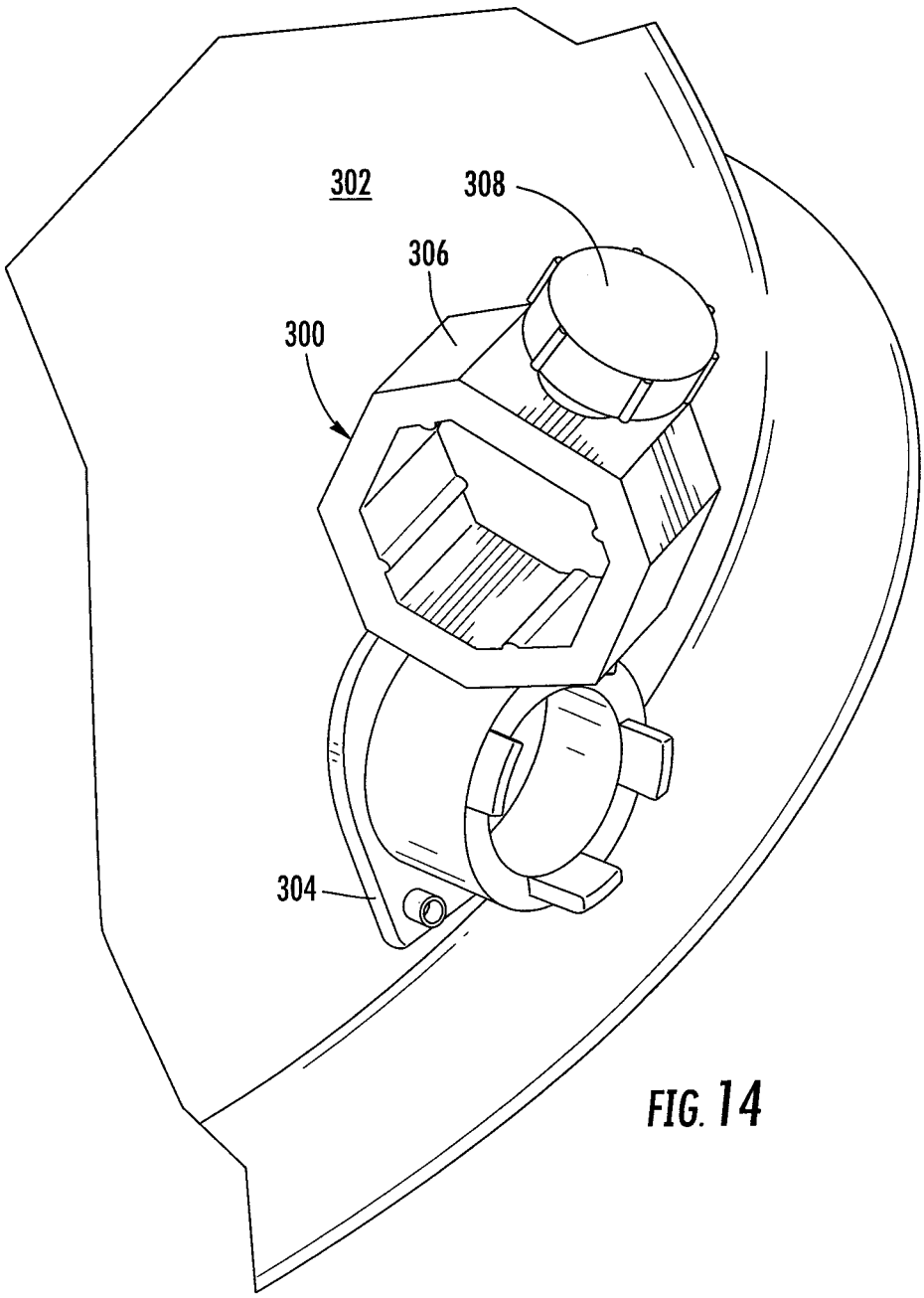
FIG. 14 is a partial perspective view taken along lines 14-14 of FIG. 13 illustrating a prior art light attachment for a hard hat.

Referring to FIGS. 13-14, a prior art light holder 300 for a hard hat 302 is illustrated. This device requires a specific aperture 304 to be formed into the hard hat 302 for attachment of the light holder. The light holder snaps into the hard hat aperture in a permanent manner whereby the light holder cannot be easily removed from the hard hat without removal of the hard hat and tools. In general, these features make these devices dangerous for use in places where the light or light holder could be caught in wires or other structures. The light holder includes a loop 306 sized to fit around a portable light (not shown) and a thumb screw 308 for securing the portable light in place. The loop and thumbscrew design prevents the user from simply reaching up and removing the portable light with one hand, and instead requires both hands for removal, one hand for holding the light and the other for loosening the thumb screw.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An illumination system for attachment to thin plate-like structure comprising:

a light source constructed and arranged to selectively generate a beam of light;

a multi-axis pivot assembly constructed and arranged to selectively retain said light source and to permit directional adjustment of said beam of light, said multi-axis pivot assembly including an open clip member, said open clip member including U-shaped body having a pair of side portions and a connecting portion, said pair of side portions constructed and arranged to spring away from each other upon insertion of said plate-like structure to engage a surface of said plate-like structure to maintain positioning of said illumination system along said plate-like structure, said multi-axis pivot assembly further includes an offset arm and a friction tube, said open clip member including a first portion of a first rotation assembly, said offset arm generally having an L-shape and includes a second portion of a first rotation assembly positioned on a first leg of said offset arm and a first portion of a second rotation assembly on a second leg thereof, said friction tube having a second portion of said second rotation assembly, said friction tube having an internal surface sized and shaped to frictionally engage said light source for selective retention thereof, said first and second portions of said first and said second rotation assemblies constructed and arranged to snap together said first and said second rotation assemblies are constructed and arranged to provide three hundred and sixty degrees of rotational freedom.

2. The illumination system of claim 1, wherein each said first portion of a rotation assembly includes a snap ring portion and a bearing race portion and each second portion of each rotation assembly includes a plurality of spring clips and a bearing portion, each said rotation assembly providing thrust and rotational bearings to provide a predetermined resistance to rotation.

3. An illumination system for attachment to thin plate-like structure comprising:

a light source constructed and arranged to selectively generate a beam of light;

a multi-axis pivot assembly constructed and arranged to selectively retain said light source and to permit directional adjustment of said beam of light, said multi-axis pivot assembly including an open clip member, said open clip member including U-shaped body having a pair of side portions and a connecting portion, said pair of side portions constructed and arranged to spring away from each other upon insertion of said plate-like structure to engage a surface of said plate-like structure to maintain positioning of said illumination system along said plate-like structure, each said first portion of a rotation assembly includes a snap ring portion and a bearing race portion and each second portion of each rotation assembly includes a plurality of spring clips and a bearing portion, each said rotation assembly providing thrust and rotational bearings to provide a predetermined resistance to rotation.

4. The illumination system of claim 1, wherein at least one of said side portions include a bevel along a leading edge thereof, said bevel constructed and arranged to cause said flexible side portions to separate as they are slid over said thin structure.

5. The illumination system of claim 4, wherein at least one of said side portions include a barb positioned between said side members, said barb constructed and arranged to engage a surface of said plate-like structure, said barb constructed and arranged to engage a surface of said plate-like structure to maintain positioning of said illumination system along said plate-like structure.

6. The illumination system of claim 1, wherein both of said side portions include a bevel along a leading edge thereof, said bevel constructed and arranged to cause said flexible side portions to separate as they are slid over said thin structure.

7. The illumination system of claim 6, wherein both of said side portions include at least one barb positioned between said side members, each said barb constructed and arranged to engage a surface of said plate-like structure to maintain positioning of said illumination system along said plate-like structure.

8. The illumination system of claim 1, wherein said plate-like structure is a portion of a hat.

9. An illumination system for attachment to a temple arm of a pair of eyeglasses comprising:

a light source constructed and arranged to selectively generate a beam of light;

a multi-axis pivot assembly constructed and arranged to selectively retain said light source and to permit directional adjustment of said beam of light, said multi-axis pivot assembly including a closed adapter clip member, said closed adapter clip member including a generally tubular structure having a plurality of grooves, each having a different width positioned between two flexible side portions, whereby said clip may be slid longitudinally along said temple arm of a pair of glasses to a desired position and snapped into a locked position progressively moving said temple arm to a desired groove.

10. The illumination system of claim 9, wherein each said groove includes at least one ridge, said at least one ridge constructed and arranged to cooperate with said temple arm to secure said adapter clip in a desired position.

11. The illumination system of claim 9, wherein each said groove includes at least one ridge positioned on opposite sides of said adapter clip, said opposing ridges constructed and arranged to cooperate with said temple arm to secure said adapter clip in a desired position.

12. The illumination system of claim 9, wherein said grooves descend in size from a first side of said adapter clip to a second side of said adapter clip.

13. The illumination system of claim 9, wherein said first and said second rotation assemblies are constructed and arranged to provide three hundred and sixty degrees of rotational freedom.

14. The illumination system of claim 9, wherein each said first portion of a rotation assembly includes a snap ring portion and a bearing race portion and each second portion of each rotation assembly includes a plurality of spring clips and a bearing portion, each said rotation assembly providing thrust and rotational bearings to provide a predetermined resistance to rotation.

15. The illumination system of claim 14, wherein said plurality of spring clips provide a break away connection to each said rotation assembly upon receiving a predetermined load.

16. The illumination system of claim 3, wherein said plurality of spring clips provide a break away connection to each said rotation assembly upon receiving a predetermined load.

* * * * *